US007070052B2

(12) United States Patent
Perry et al.

(10) Patent No.: US 7,070,052 B2
(45) Date of Patent: Jul. 4, 2006

(54) PACKAGING SYSTEM FOR CATHODE RAY TUBE COMPONENTS

(75) Inventors: Jack D. Perry, Evans City, PA (US); Sandro A. Campagna, Beaver Falls, PA (US)

(73) Assignee: SCA Packaging North America, Inc., Philadelphia, PA (US)

( * ) Notice: Subject to any disclaimer, the term of this patent is extended or adjusted under 35 U.S.C. 154(b) by 329 days.

(21) Appl. No.: 10/453,744

(22) Filed: Jun. 4, 2003

(65) Prior Publication Data

US 2004/0026285 A1 Feb. 12, 2004

Related U.S. Application Data

(60) Provisional application No. 60/386,498, filed on Jun. 4, 2002.

(51) Int. Cl.
*B65D 85/42* (2006.01)

(52) U.S. Cl. ..... 206/419; 206/422; 206/725; 206/589; 206/593

(58) Field of Classification Search ..... 206/320, 206/419, 448, 454, 486, 490, 589, 593, 725, 206/422

See application file for complete search history.

(56) References Cited

U.S. PATENT DOCUMENTS

| | | | | |
|---|---|---|---|---|
| 2,806,594 | A * | 9/1957 | Muller et al. | 206/600 |
| 3,330,407 | A * | 7/1967 | Graves et al. | 206/419 |
| 3,596,830 | A * | 8/1971 | McFarland et al. | 206/521 |
| 3,930,579 | A | 1/1976 | Kurtz | |
| 3,955,675 | A | 5/1976 | Kurtz | |
| 3,961,707 | A | 6/1976 | Lehr et al. | |
| 4,019,637 | A | 4/1977 | Kurtz | |
| 4,088,225 | A * | 5/1978 | Hartnell | 206/419 |
| 4,241,830 | A | 12/1980 | Di Gesu' | |
| 4,273,400 | A | 6/1981 | Porsch et al. | |
| 4,763,787 | A | 8/1988 | Koenig | |
| 4,860,894 | A | 8/1989 | Koenig | |

FOREIGN PATENT DOCUMENTS

| | | | |
|---|---|---|---|
| DE | 29 10 043 | * | 9/1980 |
| JP | 2001-39481 | * | 2/2001 |
| JP | 2001-219967 | * | 8/2001 |

* cited by examiner

*Primary Examiner*—David T. Fidei
(74) *Attorney, Agent, or Firm*—Buchanan Ingersoll PC

(57) ABSTRACT

A packaging system for packing and transporting CRT components, having a base portion, a top portion, and a center portion arranged between the base portion and the top portion. A first layer of CRT components can be arranged in retaining cells of the base and a second layer of CRT components can be arranged between the center portion and the top portion. A method for packaging CRT funnels or CRT face panels in a packaging system. The components can be formed from expandable foam material.

9 Claims, 13 Drawing Sheets

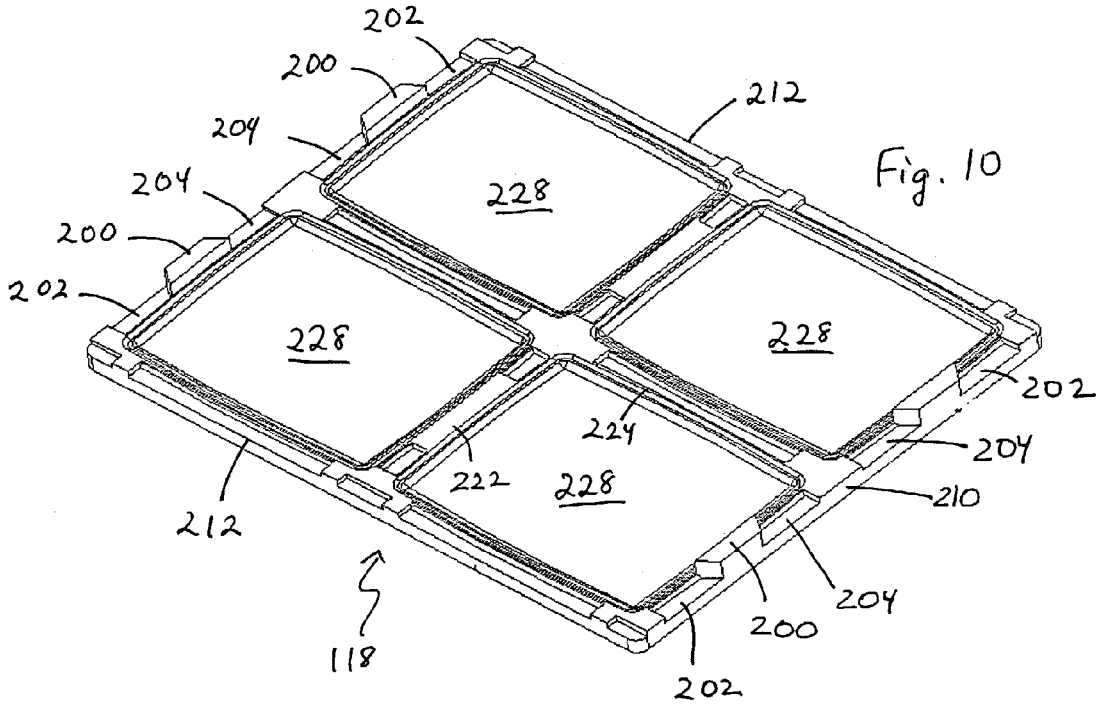
Fig. 10
Fig. 9d
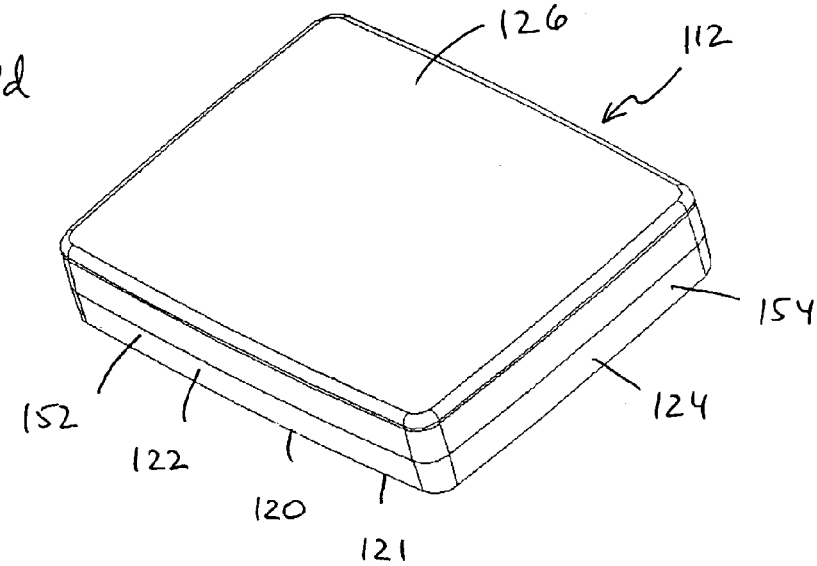

PACKAGING SYSTEM FOR CATHODE RAY TUBE COMPONENTS

CROSS-REFERENCE TO RELATED APPLICATIONS

This application claims priority under 35 U.S.C. 119 to U.S. Provisional Application No. 60/386,498, filed on Jun. 4, 2002, the entire content of which is incorporated herein in its entirety.

BACKGROUND

1. Field of the Invention

This present invention generally relates to packaging, and in particular, to packaging for cathode ray tube ("CRT") components.

2. Background of the Invention

Cathode ray tubes are typically constructed of glass funnels and glass face panels and are inherently fragile. Therefore, in transporting CRT components, careful packaging is vital in insuring-the CRT components are transported without breakage or surface abrasion. Typical CRT packaging consists of cardboard cartons utilizing corrugated components. Corrugated packaging does not tend to be reusable. Corrugated packaging can be disposable. However, when disposed of, it is a very large mass of material that if covered will remain intact for years in a landfill. Corrugated materials will lose considerable strength during rough handling, humid conditions, and water saturation. Conventional corrugated packaging for CRT components requires substantial labor in the assembly and disassembly for reuse. If the corrugated packaging is returned for reuse or inventoried, the space required to do so is very costly. Further, the corrugated material must be coated with a non-abrasive material to prevent surface abrasion to the glass.

It is also known to use reusable thermoformed plastic trays to transport CRT components. Plastic trays tend to scratch the surfaces of CRT components over long trailer rides due to the plastic tray not conforming to the CRT component surfaces very closely, thus causing excessive movement between the CRT glass and the plastic tray. Plastic trays for components also do not nest very well for return shipments, therefore increasing freight cost considerably.

SUMMARY

According to an exemplary embodiment of the present invention there is provided a packaging system for packing and transporting CRT components. The packaging system includes a base portion, a center portion and a top portion. The CRT packaging system is preferably made from lightweight molded foam material.

In one embodiment, the packaging system can include a base made of a expandable moldable foam material, to fit on a pallet of some sort, with four cells sized to snugly fit four CRT funnels placed face-down with neck upward and spaced apart to prevent damage during transport.

The embodiment further includes a center portion having a center piece and two end pieces. The center portion can be made of a expandable moldable foam material and be designed to fit snugly on top of a layer of four funnels situated in the base below, with grooves molded in the top side of the pieces to allow for another layer of funnels to be placed on top of the center portion. This layering process can be repeated so that a plurality of layers can be packaged together.

The embodiment also includes a top made of a expandable moldable foam material with flat top surface to allow unit loads to be stacked in warehousing. The underside of the top can have four cavities configured and sized to individually snugly receive the necks of the face-down funnels as well as interlock into the center portion (or base) to provide additional top to bottom strength.

Once assembled, each packaging system of the present invention can be stretched wrapped for sealing the package from moisture and dirt and then presented for shipment.

Another embodiment of the invention is a packaging system for accommodating and protecting cathode ray tube face panels and which has a base defining at least one, preferably four, receiving cells for receiving a face-up cathode ray tube face panel. The embodiment also includes a center portion disposed between the base and the top, wherein the center portion includes at least two end pieces and at least one center piece arranged between the at least two end pieces. A top fits on top of the center portion. The base has a horizontal ledge on at least one, preferably both, of two pairs of opposed walls, and a horizontal ledge on at least one, and preferably both, of a first rib and a second rib, the first rib and the second ribs intersecting and each rib extending between one of the pairs of opposed walls.

Another embodiment of the invention includes a method for packaging a plurality of CRT components in a packaging system having a base, a top portion, and a central portion arranged between the base and the top portion. In the method, a first layer of CRT components is arranged in receiving cells of the base. A central portion is arranged atop the first layer of CRT components and a second layer of CRT components is arranged on the central portion. A top is arranged above the second or uppermost layer.

These and other features and characteristics of the present embodiments of the invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood as an illustration only and not intended as a definition of the limits of the invention.

BRIEF DESCRIPTION OF THE DRAWINGS

FIG. 9*d* is a perspective view of a CRT face panel to be packaged in the second embodiment;

FIG. 10 is a perspective view of the underside of a top portion of the FIG. 8 packaging system;

DETAILED DESCRIPTION OF PREFERRED EMBODIMENTS

Figure 1:
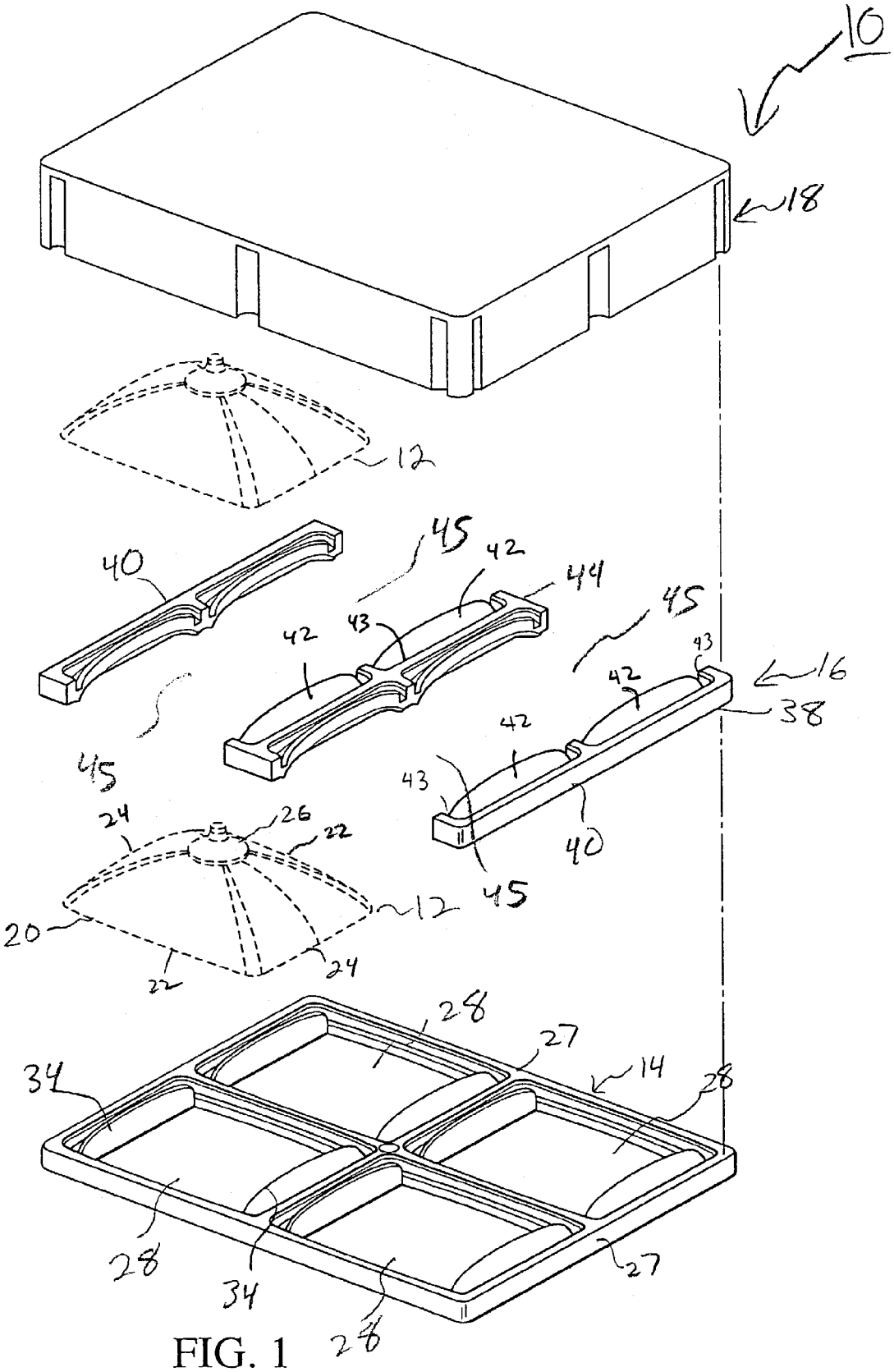
FIG. 1 is an exploded perspective view of the packaging system of an embodiment of the present invention.
Figure 2:
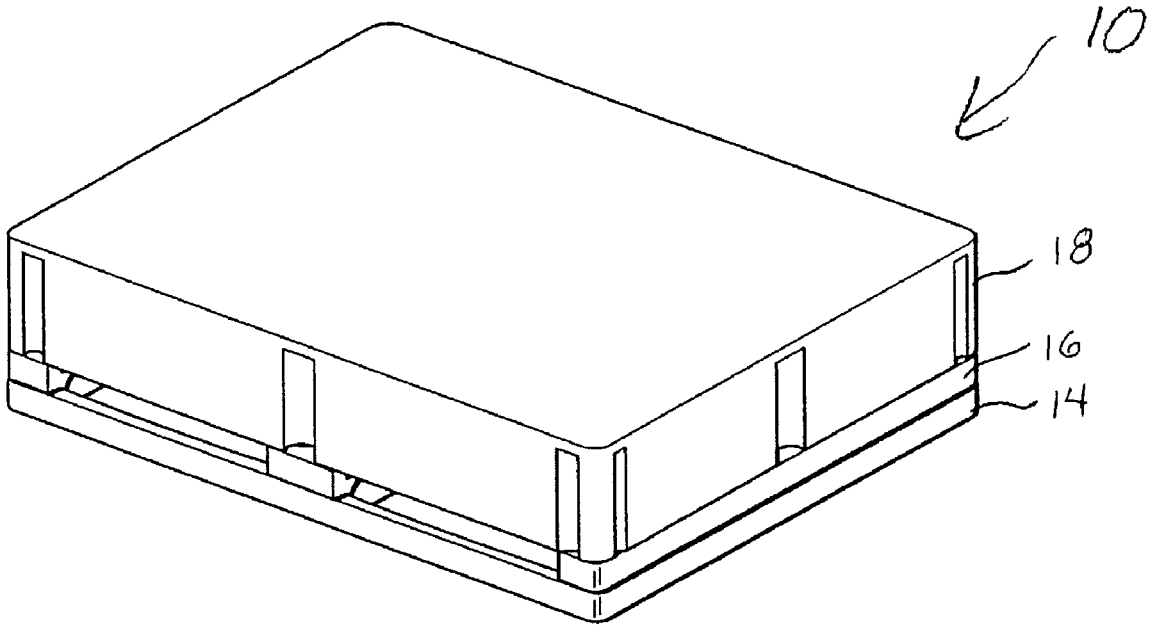
FIG. 2 is a perspective of the assembled packaging system of FIG. 1.
Figure 3:
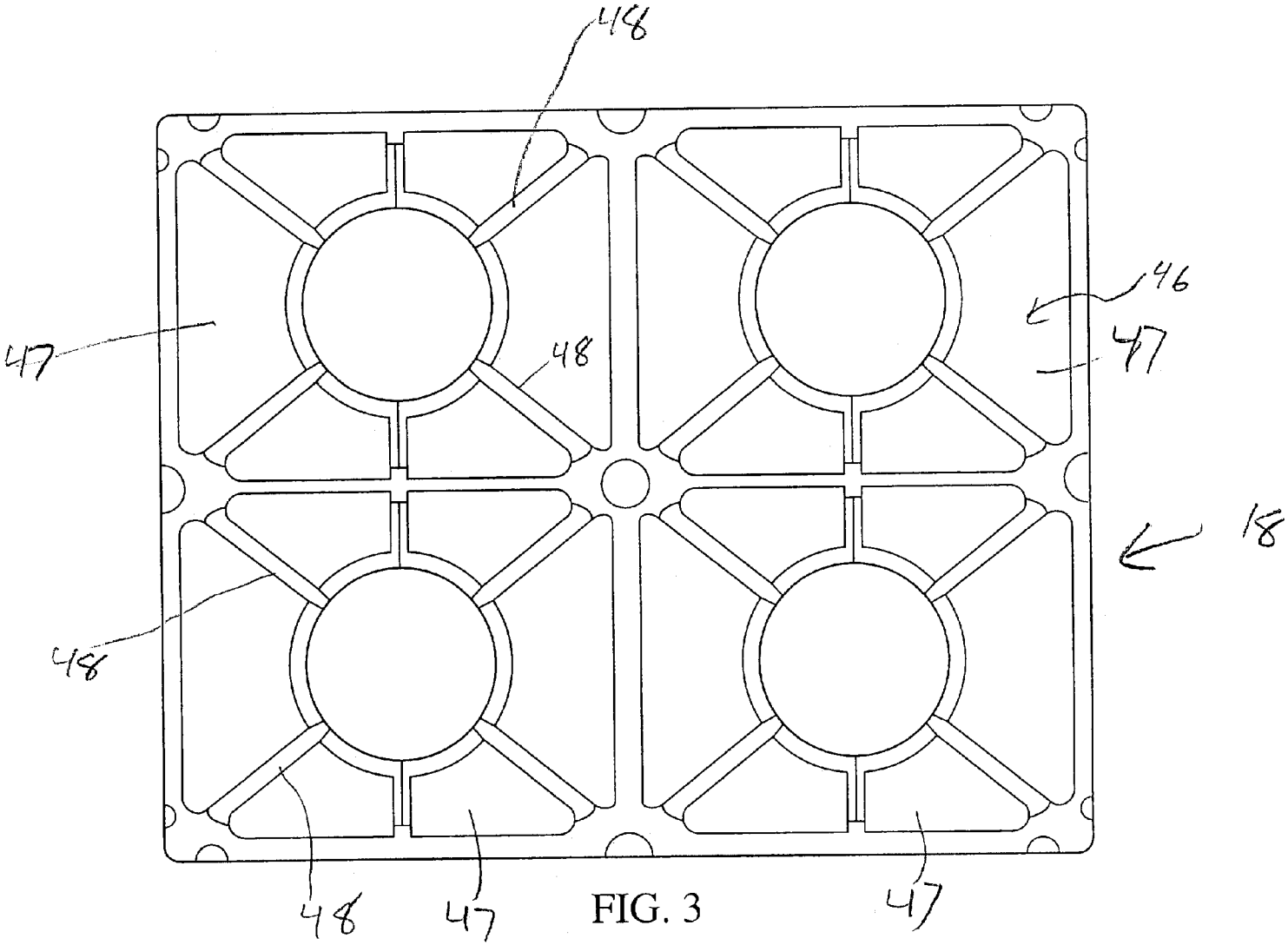
FIG. 3 is a bottom view of the top tray of FIG. 1.
Figure 4:
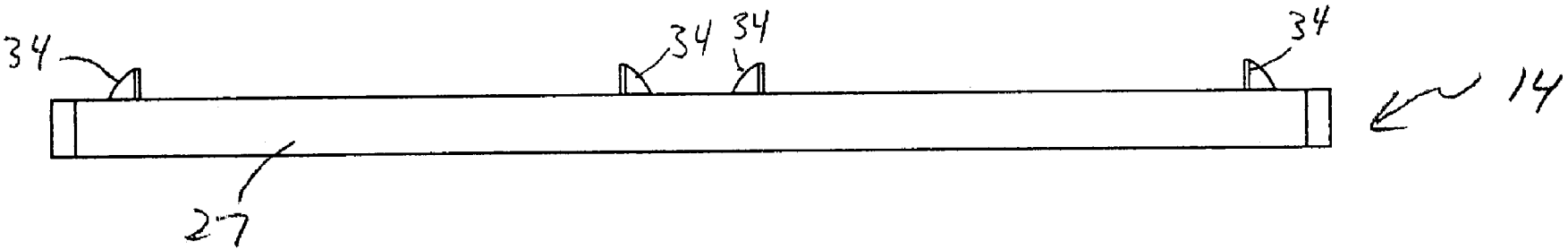
FIG. 4 is a front view of the bottom tray of FIG. 1.

FIGS. 1–7 illustrate an exemplary embodiment according to the principles of the present invention. There is illustrated a packaging system 10 especially for cathode ray tube (CRT) funnels 12., The illustrated embodiment comprises three basic components for securing one or more CRT funnels 12: a base 14; a center portion 16; and a top 18.

Figure 7:
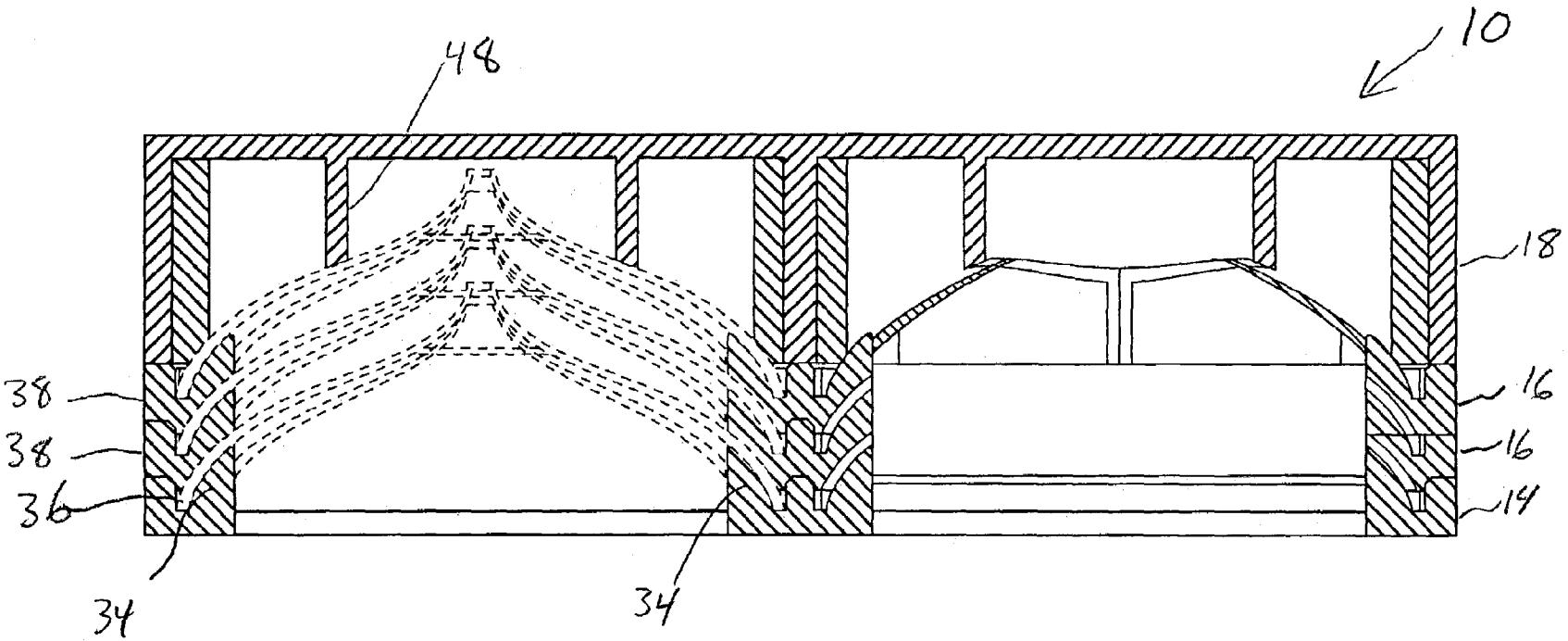
FIG. 7 is a cross-sectional view of a packaging system of an embodiment of the present invention having two center portion layers.

Each CRT funnel 12, as can be seen in FIGS. 1 and 7, is funnel shaped with a base part 20 having two long sides 22 and two short sides 24, and a neck portion 26. As illustrated in FIG. 1, the CRT funnels 12 are arranged in a facedown configuration with the base part 20 of each CRT funnel 12 facing downward toward the base 14 of the packaging system 10 and the neck part of the CRT funnel facing upward toward the top 18 of the packaging system 10.

Figure 5:
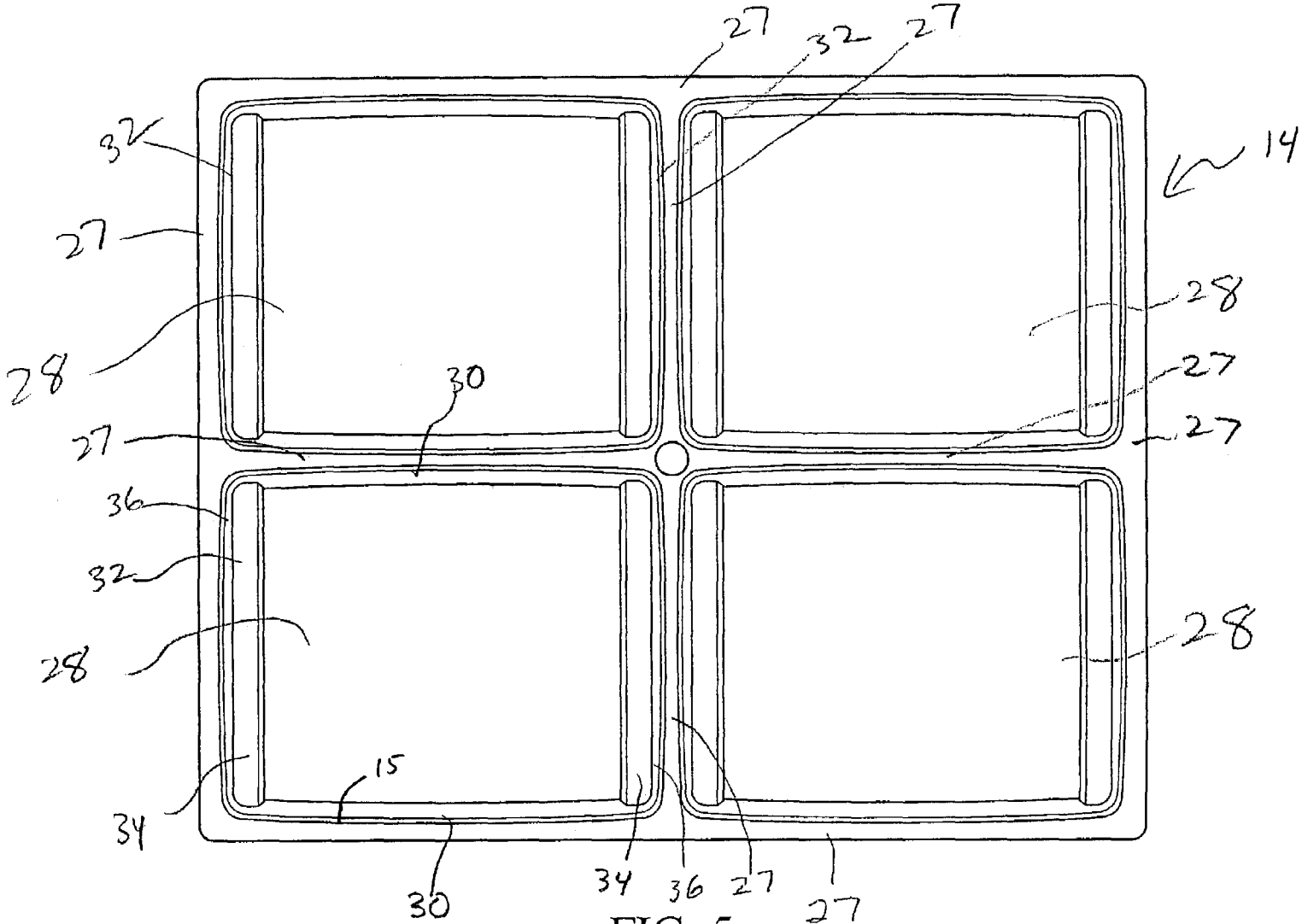
FIG. 5 is a top view of the bottom tray of FIG. 1.

As best seen in FIGS. 1, 5 and 7, the base 14 of the packaging system is a rectangular structure 27 having receiving cells 28 within its periphery. In this embodiment, four receiving cells 28 are shown, however, it is contemplated that packaging systems of other sizes and arrangements can be provided. Each receiving cell 28 is rectangular having two long sides 30 and two short sides 32 and is designed to receive the base part 20 of a CRT funnel 12. See FIG. 5. The rectangular structure 27 of the base 14 forms an upwardly extending ridge-like structure 15 surrounding each cell 28 in an peripheral manner.

The base 14 is a unitary structure formed from molded expandable foam. The base 14 is designed to hold 4 stacks of CRT funnels 12. The base 14 locates the bottom layer of CRT funnels 12 to ensure the parts form vertical columns of funnels. To do this, each rectangular cell 28 includes an upwardly protruding lip 34 disposed across each short side 32 interior of the peripheral ridge 15. A groove 36 is formed between each peripheral ridge 15 and a respective lip 34. The lips 34 are adapted to contact the inside of the short sides 24 of the rectangular base part 20 of the CRT funnel 12. The grooves 36 are adapted to receive the peripheral edge of the rectangular base part 20 of the CRT funnel 12. The base 14 is designed to fit on a pallet of equal or larger size.

All components of the packaging system 10 are preferably formed from expandable moldable foam such as expanded polystyrene, expanded polyethylene, expanded polypropylene, and foams available under the trade-names ARCEL and RMER.

Figure 6:
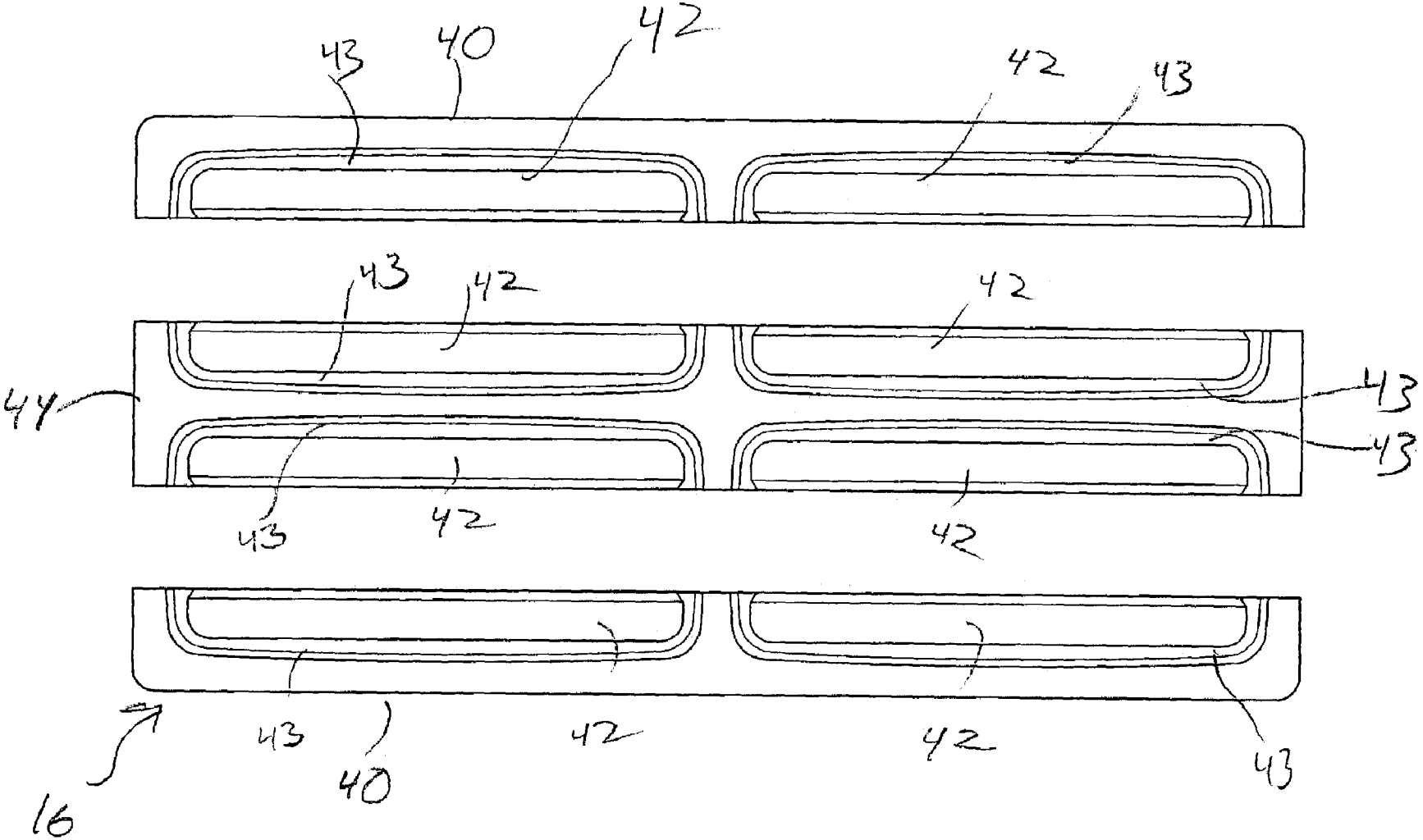
FIG. 6 is a top view of the center portion of FIG. 1.

An embodiment of the present invention is adapted to support stacks of CRT funnels nested within each other. In order to separate the layers of CRT funnels 12 from each other, a center portion 16 is provided to cushion and support the funnels 12 (FIGS. 1, 6 and 7). The center portion 16 can include one or more layers 38 to separate the CRT funnels 12. Alternatively, if only a single layer of funnels is desired, no center portion 16 is needed, and the CRT funnels 12 will be arranged between the top 18 and the base 14.

A top portion of each center portion layer 38 can be substantially similar to the base 14 in that it includes groove and lip portions on an upper side, however, each center portion layer 38 does not include the long sides of the rectangular cells of the base. Thus, each center portion layer 38 comprises three pieces including two end pieces 40 each having two lips 42 and two grooves 43 and a center piece 44 having four lips 42 and four grooves 43. The two end pieces 40 and center piece 44 form four receiving cells 45 for receiving CRT funnels. The end pieces 40 and the center piece 44 are supported on top of the base 14 or another center portion layer 38. Additional layers of the center portion 16 are supported on the underlying layer 38 rather than on the base 14. The number of layers 38 depends on the number of funnels in the stacks which is dependent on how much weight can be hauled in a transportation trailer.

The top 18 is designed to sit on top of the two end pieces 40 and the center piece 44 of the uppermost layer 38 of the center portion 16 below the top 18 (or on the base 14 if no center portion 16 is present) to form a solid level surface for stacking additional packaging systems 10 of funnels. The underside 46 (FIG. 3) of the top 18 includes four cavities 47 having ribs 48 to support the funnel so as to provide top support for a second packaging system of funnels placed on top of the packaging system 10 for warehousing or shipping. After the top 18 is placed in position, the entire unit load is stretched wrapped.

A percentage of the foam can be reused as recycled material and molded back into funnel packaging parts or other foam parts. In fact, after the packaged CRT funnels are received, completed CRTs are manufactured. While the CRT funnels are being manufactured into CRTs, the above-described packaging material can be recycled into packaging material adapted to ship the completed CRTs. Thus, an efficient system can be implemented wherein the foam can be recycled and reused at the CRT manufacturing plant area to avoid the need to ship the foam packaging components by themselves.

Because the foam material does not scratch glass, it is not necessary to add additional surface protection material between the foam components and the funnels. The packaging system provides a layered packaging system which allows the user to increase or decrease the number of layers to adjust the total weight of the shipping trailer. The packaging materials of the present invention, because of the center rails, occupy less space than conventional foam molded trays, thus requiring less inventory space and considerable freight savings to ship. Lightweight foam packaging allows the manufacturer to ship more product and less packaging to a customer, which is a significant cost advantage. Further, the lightweight packaging is easier on assembly line workers during the actual packaging process due to the decreased weight of the foam material compared to plastic trays.

The packaging system for the cathode ray tube funnels is illustrated as being rectangular but other shapes and configurations are also contemplated. While the illustrated embodiments are shown as having one layer of the center portion (FIGS. 1 and 2) and two layers 38 of the center portion 16 (FIG. 7), the present invention also contemplates systems having no center portion or a center portion having more than two layers 38.

Cathode ray tube funnels are integrated with a glass face panel and a neck to form a CRT assembly. These components can be manufactured at different locations by different manufacturers and shipped to an assembly plant to be formed into a cathode ray tube assembly. Such a cathode ray tube assembly can then be integrated into a final product such as a television set or computer monitor.

Figure 8:
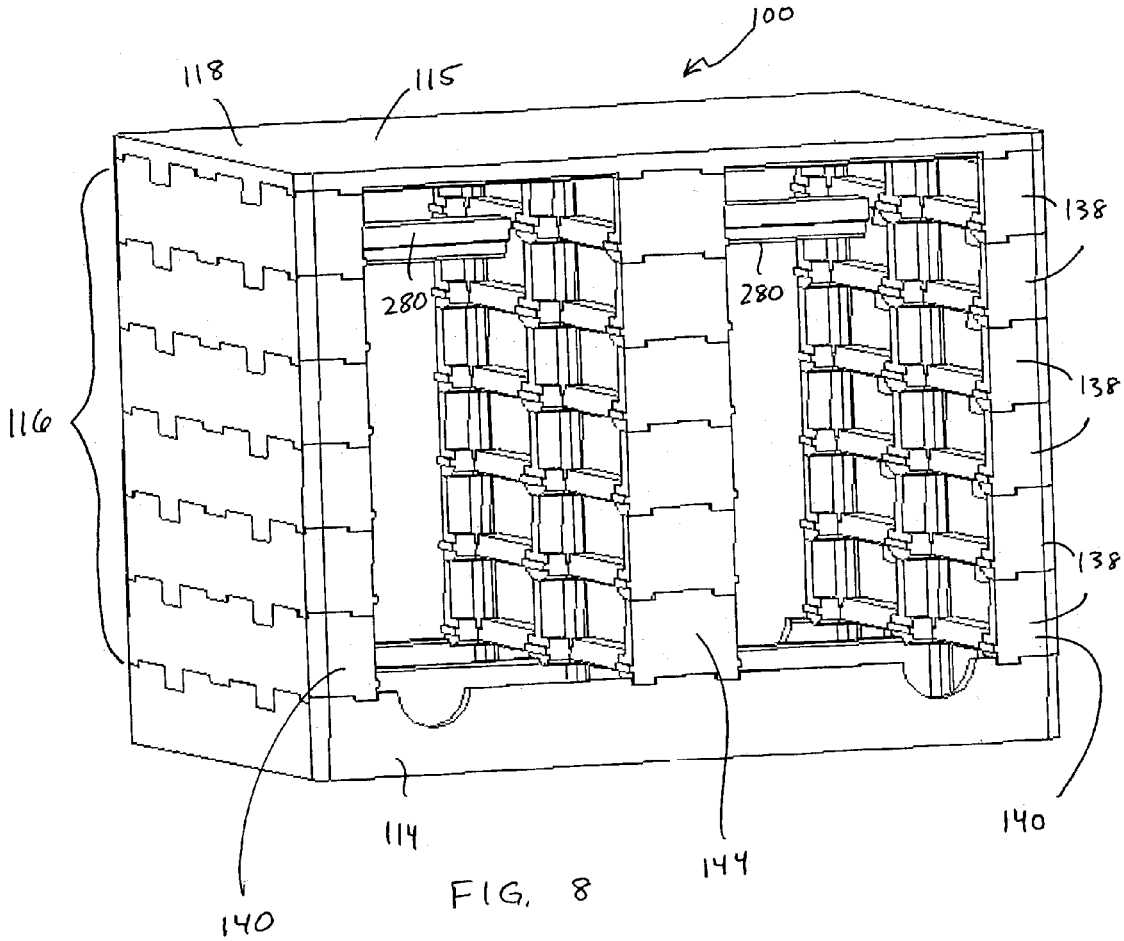
FIG. 8 is a perspective view of an assembled packaging system according to a second embodiment of the invention.

In order to transport the face panels to the CRT assembly plant, the above-described system can be adapted for transporting the face panels. FIG. 8 illustrates an exemplary embodiment of a packaging system for face panels according to the principles of the present invention. The packaging system 100 includes a top 118, a base 114, and at least one center portion 116. The center portion 116 includes one or more layers 138 between the top 118 and the base 114. Alternatively, the packaging system 100 can include no center portions 116, with the top 118 arranged directly atop the base 114 for transporting a single layer of face panels 112.

The assembled packaging system 100 of FIG. 8 includes six center portion layers 138 stacked upon each other, with spaces for seven layers of CRT face panels, the CRT face panels being stacked in vertical columns with a center portion layer 138 separating each layer of CRT face panels from each other, although the packaging system can have more or fewer layers of CRT face panels 112 separated by center portions layers 138. Although the present invention is clearly not limited to any particular number of layers.

The packaging system 100 can be sized to fit upon a standard transportation pallet 150 which is the same size as the packaging system or larger.

As illustrated in FIG. 9*d*, each face panel 112 has an approximately rectangular base part 120 having a peripheral edge 121 formed of two long edges 122 and two shorter edges 124. The face panel 112 also has a face portion 126, and two pairs of opposite sides 152 and 154 extending from the peripheral edges 121 to the face portion 126 of the face panel 112. FIG. 9*d* illustrates the face panel 112 in a face-up configuration with the face portion 126 is approximately horizontal and above the base part 120.

Figure 9A:
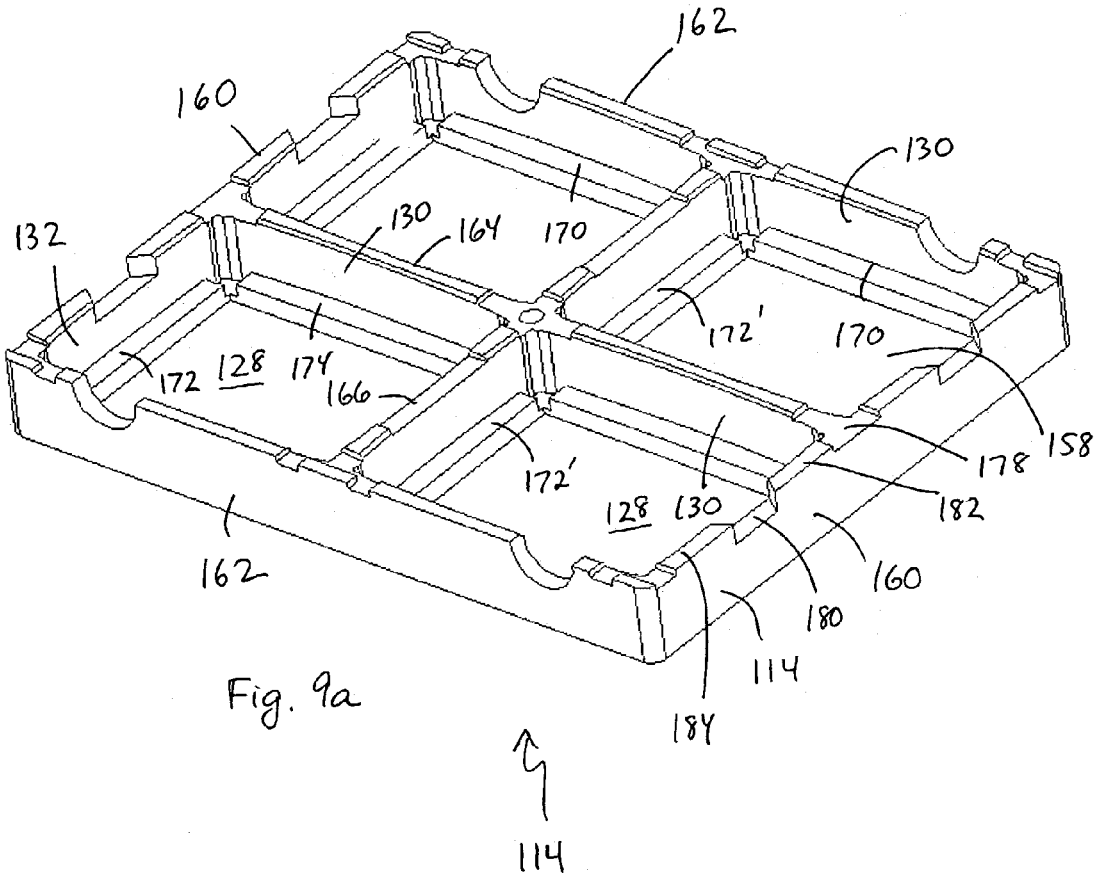
FIG. 9*a* is a perspective view of a bottom portion of the second embodiment.

In this embodiment, the base 114 has four receiving cells 128 within its periphery, although it may have fewer or more receiving cells 128. As illustrated in FIG. 9*a*, each receiving cell 128 is approximately rectangular with two long sides 130 and two short sides 132, for receiving the CRT face panels 112. The base 114 supports a bottom layer of face panels 112, with one face panel in each receiving cell, to ensure the face panels form vertical columns.

The base 114 has two opposed short outer walls 160, two opposed longer outer walls 162, and two centrally arranged ribs 164 and 166 which extend between the outer walls 160 and 162, respectively. The interior surfaces of the outer walls 160 and 162 and the ribs 164 and 166 define the sides 130 and 132 of the receiving cells 128. Preferably, the receiving cells are sized so the sides 132 and 130 snugly contact at least part of each of the face panel sides 152 and 154. The receiving cells 128 are shaped to hold the face panel 112 in a face-up orientation, with the peripheral edge 121 facing toward the base 114 and the face portion 126 facing in an upward direction away from the base 114. The face portion 126 of the face panel 112 is preferably recessed approximately 0.5 inches below an upper surface of the base 114 in each receiving cell 128. If the face panel has a curvature, a portion of the face panel may extend above the upper surface of the base portion 114.

In each receiving cell 128, horizontal ledges support the base part 120 of the face panel 112. Each ledge can extend from a lower part of the sides 130 and 132. For example, a ledge 172 extends from the lower part of the side 132 formed by one of the shorter outer walls 160. Another ledge 170 extends from the lower part of the side 130 formed by one of the longer outer walls 162. A third ledge 174 extends from the lower part of the side 130 formed by the rib 164. A fourth ledge 172' extends from a lower part of the side 132 formed by the rib 166. The peripheral edge 121 of the face panel 112 rests upon the four ledges.

The upwardly facing surface of the base 114 has a profile of raised and recessed sections which can engage a corresponding profile on the lower surface of one of the center layers 138 or a corresponding profile on a lower surface of the top 118. Each of the short outer walls 160, the longer outer walls 162, and the ribs 164 and 166 have an upper surface with raised and recessed sections.

Along an upper surface of the short outer wall 160 of the base 114, a recessed section 180 of the wall is wider at inner surface of the wall 160 than at the outer surface of the wall 160. On each side of the recessed section, raised sections 182 and 184 form an upper plane of the base 114. The raised sections 182 and 184 are wider at the inner surface of the wall 160 than at the outer surface. Each of the four receiving cells 128 has a recessed section 180 and raised sections 182 and 184 along the shorter outer walls 160, with each recessed section 180 arranged approximately midway along the shorter side 132 of the receiving cell 128.

As discussed in greater detail in later paragraphs, corresponding profiles on the upper and lower surfaces of the center layers 116 and on the lower surface of the top 118 are provided to allow the center layers 116 and top 118 to engage the profile of the base 114, in order to keep the center layers 116 and top 118 correctly positioned with respect to the base 114.

As illustrated in FIG. 9*a*, the upper surfaces of the longer outer walls 162 and the ribs 164 and 166 also have a profile of raised and recessed sections which correspond to the lower surfaces of the center portion 116 and the top 118. These sections further maintain the correct position of the top 118 and the center portion 116 with respect to the face panels 112 and the base 114.

The top 118 is a rectangular structure adapted to rest upon the uppermost center portion layer 138 and on the face panels 112 arranged between the uppermost layer 138 and the top 118. If no center portion 116 is present, the top 118 rests upon the base 114 and on a single layer of face panels 112 arranged between the base and the top 118. The upper surface 115 of the top 118 is preferably flat (FIG. 8) to accommodate stacking additional packaging systems 100.

FIG. 10 illustrates that the top 118 includes two opposed short outer walls 210, two opposed longer outer walls 212, and central perpendicularly arranged ribs 222 and 224 extending between the opposed short outer walls 210 and the opposed longer outer walls 212, respectively. The top 118, together with an uppermost layer 138 of the central portion 116, defines four receiving cells 228 for a layer of four face-up face panels 112. The ribs 222 and 224 of the top 118 separate the vertical columns of CRT face panels 112 and strengthen the top 118 for supporting another packaging system 100.

The underside of the top, illustrated in FIG. 10, faces the center portion 116 and the base 114, and preferably is shaped to engage the upper surfaces of the center portion 116 or the base 114. For example, the lower surfaces of the short outer walls 210 and the rib 222 are shaped to engage the end pieces 140 and center piece 144 of a central portion layer 138. If no central portion layers are present, the lower surfaces of the short outer walls 210, the longer outer walls 212, and the ribs 222 and 224 rest on and interlock with the corresponding walls 160, 162 and ribs 164 and 166 of the base 114.

This embodiment further provides that the surface of the ribs 222 and 224 and the outer walls 210 and 212 facing toward the glass panels 112 have a profile which matches the shape of the upper surface of the face panels 112 so that when the top 118 is placed on the top layer of face panels 112, the top portion 118 preferably at least partially rests on the upper surface of the face panels 112.

As illustrated in FIG. 10, the short outer walls of the top 118 have a lower surface intended to engage the end pieces 140 or the base 114. Recessed sections 202 and 204 have a raised section 200 defined between them. The raised section 200 is shaped to fit within the recessed sections 180 and 190 of the end pieces 140 or the base 114, respectively. The recessed sections 202 and 204 are shaped to receive the raised sections 182 and 184 of the base 114 or the raised sections 192 and 194 of the end piece 140. Thus, to engage the end piece 140 and base 114, the recessed sections 202 and 204 of the top portion 118 are wider at an outer surface of the wall 210 than at the inner surface, and the raised sections 200 are wider at an inner surface of the wall 210 than at an outer surface.

Figure 9B:
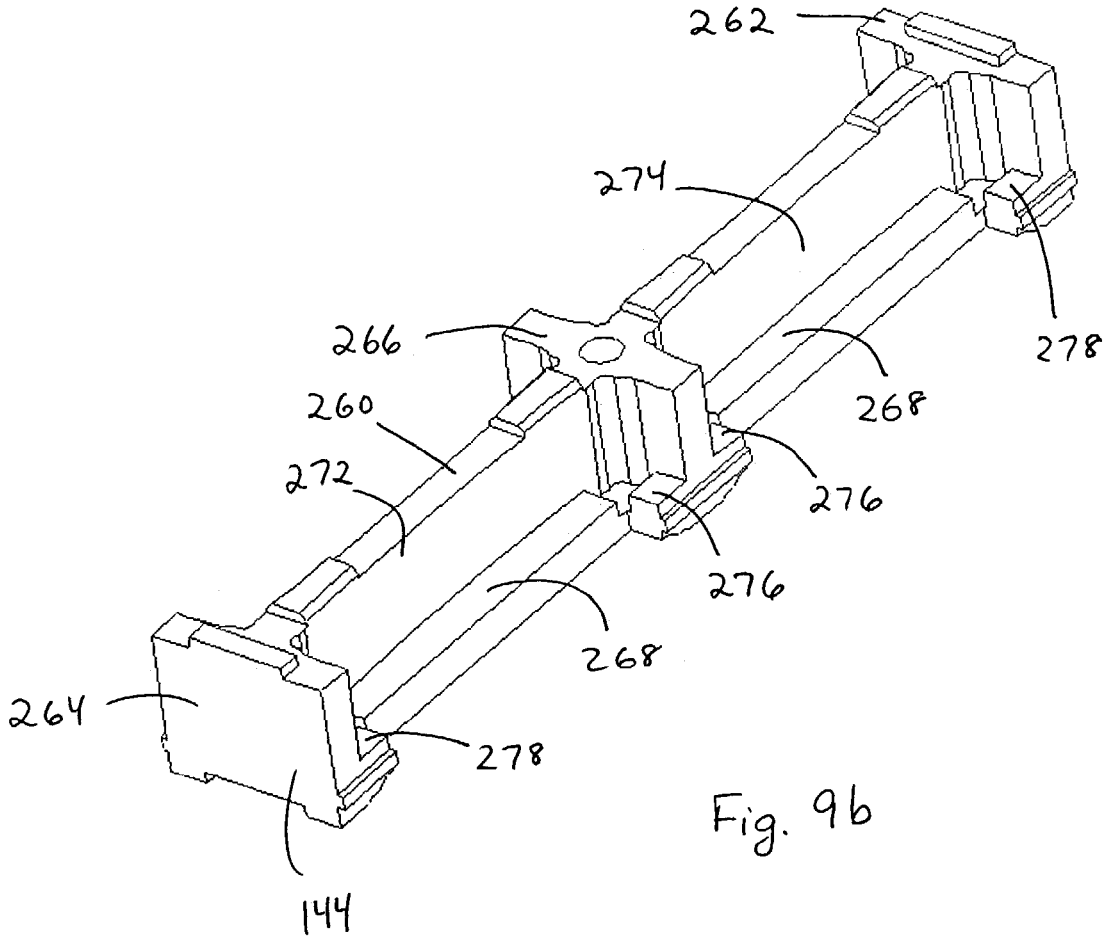
FIG. 9*b* is a perspective view of a part of the center portion of the second embodiment.
Figure 9C:
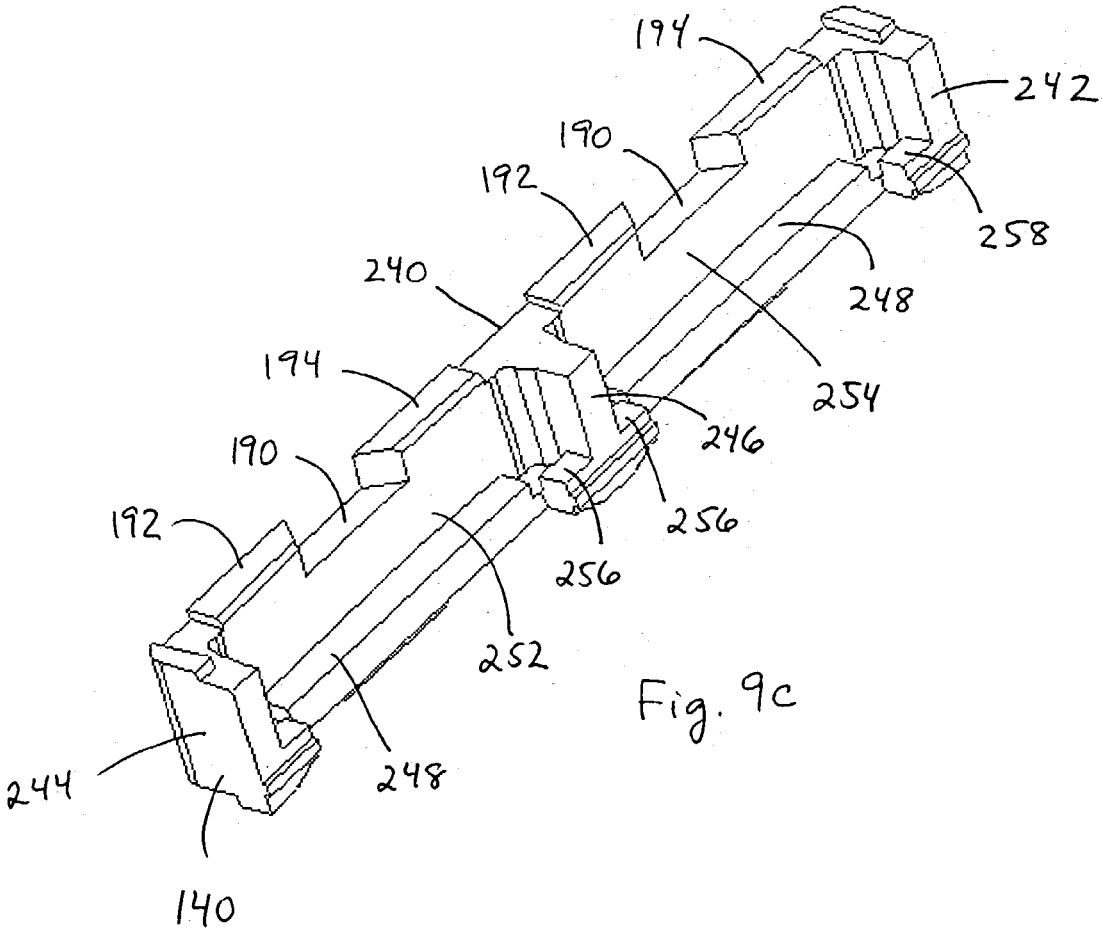
FIG. 9*c* is a perspective view of another part of the center portion of the second embodiment.
Figure 11:
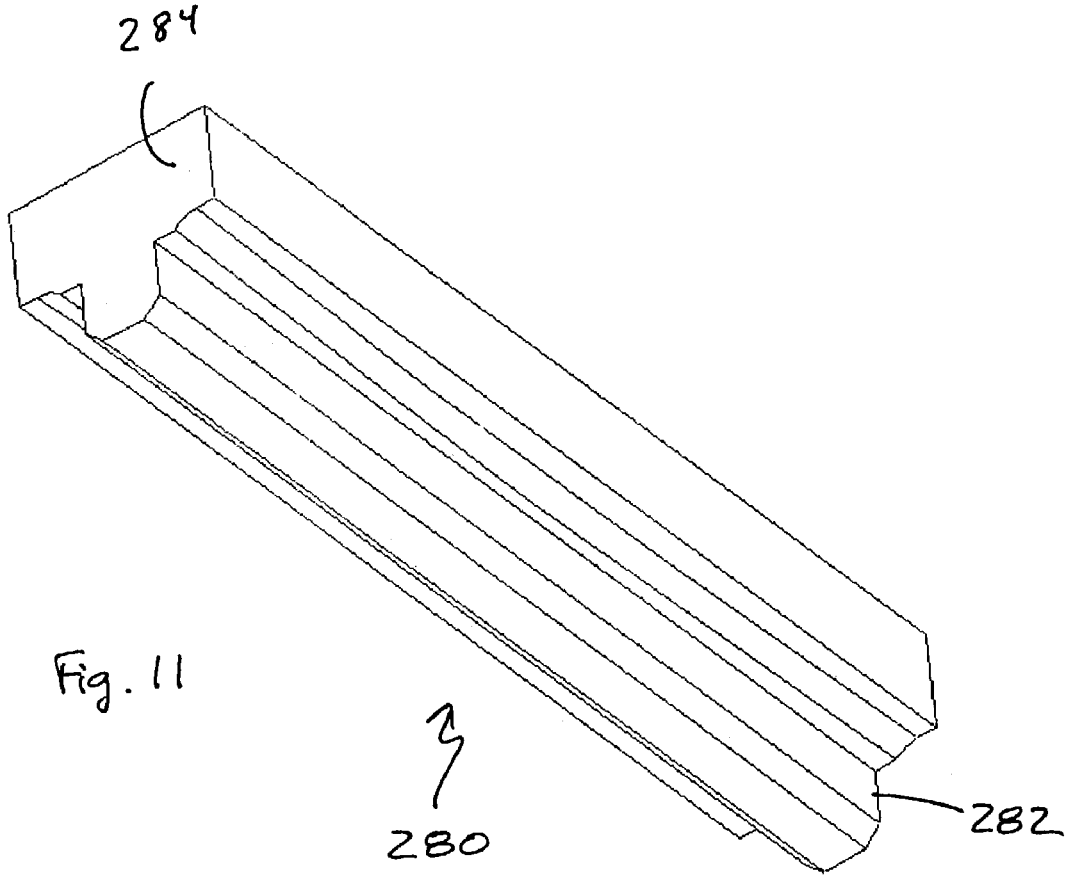
FIG. 11 is a perspective view of an insert for use with the second embodiment.

As illustrated in FIGS. 8, 9*b* and 9*c*, each of the center portion layers 138 includes two end pieces 140 and a center piece 144. The two end pieces 140 and center piece 144 form receiving cells for storing the face panels 112. For example, the end pieces 140 and center piece 144 form four receiving cells 228 for face panels. The end pieces 140 and center piece 144 form four receiving cells 128 for face panels.

In this embodiment, the center piece 144 is supported on top of the base 114 and on the upper surface of the face panel portion 112. In packaging systems having more than one center portion layer 138, the upper center pieces 144 are supported on top of a face panel 112 and on top of another center piece 144. Similarly, the end pieces 140 are supported on the upper surface of the face-up face panel 112 and on top of the short outer walls 160 of the rectangular base 114 which underlie the end pieces 140. When multiple center portion layers 138 are present, the upper layers of end pieces 140 are supported by the face panels 112 and other end pieces 140.

The end piece 140 illustrated in FIGS. 8 and 9*c* is adapted to support a part of the lower peripheral edges 121 of two face panels 112. A longitudinal rib 240 extends from one end part 246 of the end piece 140 to the other end of the end piece 140, with one side of the longitudinal rib 240 forming part of an outside surface of the packaging system 100 and the other side of the longitudinal rib 240 forming sides of the receiving cells. A shorter perpendicularly arranged rib portion 246 extends inward from a side of the principal longitudinal rib. Ledges 248 extend horizontally from a lower part of each of the vertical walls 252 and 254. Shorter ledge portions 256 extend from a lower part of each of the shorter rib portions 246, and ledge portions 258 extend horizontally from a lower part of each of the end pieces 242 and 244. A ledge 248 and the adjacent ledge portions 256 and 258 are preferably disposed at approximately the same height, in order to provide a level receiving surface for the end of the face panel 112.

The upper surface of the end pieces 140 can have a profile substantially the same as the above-described profile of the upper surface of the short outer walls 160 the base 114. As illustrated in FIG. 9*c*, recessed sections 190 are wider at inner surface than at the outer surface. On either side of the recessed section 190, raised sections 192 and 194 are wider at the inner surface than at the outer surface.

The lower surface of each end piece 140 has a profile substantially the same as the above-described lower surface of the top 118, allowing the end pieces 140 to engage the profile of the base 114 or another end piece 140.

The center piece 144 illustrated in FIGS. 8 and 9*b* is adapted to support an opposite side of the base part of four face panels 112. A longitudinal rib 260 extends from one end part 262 to the other end part 264 of the center piece 144 (FIG. 9*b*). A shorter rib portion 266 arranged approximately midway between the ends 262 and 264 extends from each side of the longitudinal rib 260. Ledges 268 extend horizontally from vertical walls 272 and 274 on each side of the longitudinal rib 260 to support the peripheral edge 121 of the face panels 112. Four shorter ledge portions 276 extend from the lower part of the shorter rib portion 266. At each end of the center piece 144, shorter ledge portions 278 extend from a lower part of each of the end parts 262 and 264.

Thus, the ledge 268 and the shorter ledge portions 278 and 276 form a surface for supporting an end of the face-up face panel 112. Preferably, the ledges of the end pieces 140 and the center piece 144 are arranged at approximately the same height to provide a level surface for the face panels 112.

The ribs 164 and 166 of the base 114 and the long outer walls 162 can also have raised and recessed sections along an upper surface for supporting corresponding recessed and raised sections of the central part 144 or the top 118.

Each of the base 114, end pieces 140, center piece 144, and top 118 can be a unitary structure which can be formed from molded expandable foam, or any other suitable material. All components of the packaging system 100 are preferably formed from expandable moldable foam such as expanded polystyrene, expanded polyethylene, expanded polypropylene, and foams available under the tradenames ARCEL and RMER. The shape and size of the components can be produced with shapes and sizes intended to match the particular shape and size of different models of CRT face panels.

In this manner, a number of CRT face panels 112 can be secured for transport in a lightweight packaging container. Once assembled, the entire packaging system 100 can be stretch wrapped.

According to the preferred embodiment of the present invention that is adapted for CRT face panels, in order to increase the protection of the face panels, it is preferred to have each center portion and the top portion rest directly on the underlying layer of face panels. This contact between the face panels and the support layers reduces vibration and the likelihood of damage during transit.

It is also preferred to have inserts 280 between the top layer of face panels and the layer of face panels directly beneath the top layer. The inserts are substantially T-shaped in cross section and have a narrow ridge 282 which extends between adjacent face panels, while the broader beam 284 rests on the top face 126 of the two adjacent face panels. The insert helps stabilize the stack of face panels and reduces vibrations that may be caused by the resonant frequency of the system.

Whereas, in the first embodiment, the center portion pieces rest primarily on the layer of packaging below it, as opposed to resting on the CRT funnels, in the second embodiment, it is preferred that the center pieces and the top piece rest primarily on the face plate below it, as opposed to resting on the packaging below it. Such an arrangement helps to stabilize the system.

The previously mentioned advantages of the packaging system for the cathode ray tube funnels are equally applicable to the described packaging system for the cathode ray tube face panels. Further, the foam packaging system for transporting the CRT face panels may be recycled in the manner described above to form packaging for completed CRT assemblies.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims.

What is claimed is:

1. A packaging system for accommodating and protecting cathode ray tube (CRT) components, the system comprising:

a base portion forming a plurality of receiving cells for a first layer of CRT components;

at least one center portion adapted to be above the base portion of the package system so as to secure a first layer of CRT components between the base portion and the at least one center portion, the at least one center portion including at least three separate and distinct pieces defined by at least one center piece and two outer pieces separate from the at least one center piece, the at least one center portion and the two outer pieces defining a plurality of receiving cells for base parts of a second layer of CRT components; and a top portion adapted to be above said at least one center portion so as to secure an uppermost layer of CRT components between said at least one center portion and the top portion, the top portion defining a cavity for receiving the uppermost layer of components;

wherein the CRT components are CRT funnels and each of the receiving cells of the base portion includes at least one lip protruding upwardly at an angle so as to engage an inner surface of the respective CRT funnel.

2. The packaging system of claim 1, wherein the base portion, top portion and the at least one center portion are made from foam.

3. The packaging system of claim 1, wherein the CRT components are glass.

4. The packaging system of claim 1, wherein the receiving cells are rectangular.

5. The packaging system of claim 1, wherein each of the receiving cells of the at least one center portion includes at least one lip protruding upwardly at an angle so as to engage an inner surface of the respective CRT funnel.

6. The packaging system of claim 1, wherein the CRT components are CRT funnels and the at least one center portion is adapted to contact the base portion.

7. A packaging system for accommodating and protecting cathode ray tube (CRT) components, the system comprising:

a base portion forming a plurality of receiving cells for a first layer of CRT components;

at least one center portion adapted to be above the base portion of the package system so as to secure a first layer of CRT components between the base portion and the at least one center portion, the at least one center portion including at least three separate and distinct pieces defined by at least one center piece and two outer pieces separate from the at least one-center piece, the at least one center portion and the two outer pieces defining a plurality of receiving cells for base parts of a second layer of CRT components; and a top portion adapted to be above said at least one center portion so as to secure an uppermost layer of CRT components between said at least one center portion and the top portion, the top portion defining a cavity for receiving the uppermost layer of components;

wherein the base portion includes a first pair of opposed side members, a second pair of opposed side members, a first rib extending between the first pair of opposed sides, and a second rib extending between the second pair of opposed sides, the pairs of opposed sides and the first and second ribs forming the receiving cells.

8. The packaging system according to claim 7, the base portion having:

at least one first horizontal ledge disposed on an inner wall of at least one of the first and second pairs of opposed sides, at least one second horizontal ledge disposed on a wall of the first and second ribs, the horizontal ledges being adapted to receive a peripheral edge of the base portion of the CRT component.

9. The packaging system according to claim 1, further comprising inserts arranged between a top layer of CRT components and a layer immediately beneath the top layer.

* * * * *